US009501987B2

(12) United States Patent
Oh et al.

(10) Patent No.: US 9,501,987 B2
(45) Date of Patent: Nov. 22, 2016

(54) LIQUID CRYSTAL DISPLAY DEVICE AND DRIVING METHOD THEREOF

(71) Applicant: LG Display Co., Ltd., Seoul (KR)

(72) Inventors: DaeSeok Oh, Paju-si (KR); YongHwa Park, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 129 days.

(21) Appl. No.: 14/055,421

(22) Filed: Oct. 16, 2013

(65) Prior Publication Data

US 2014/0176839 A1 Jun. 26, 2014

(30) Foreign Application Priority Data

Dec. 21, 2012 (KR) ..... 10-2012-0150467

(51) Int. Cl.
*G09G 3/36* (2006.01)
*G02F 1/1345* (2006.01)

(52) U.S. Cl.
CPC ..... *G09G 3/3655* (2013.01); *G09G 2300/043* (2013.01); *G09G 2300/0426* (2013.01); *G09G 2320/0209* (2013.01)

(58) Field of Classification Search
CPC ..... G09G 3/3674; G09G 3/3655
USPC ..... 345/100, 212, 691; 349/149
See application file for complete search history.

(56) References Cited

U.S. PATENT DOCUMENTS

2007/0182909 A1* 8/2007 Kim et al. ..... 349/149
2008/0001903 A1* 1/2008 Chung ..... G09G 3/3655 345/100
2011/0032241 A1* 2/2011 Jeong et al. ..... 345/212
2011/0292099 A1* 12/2011 Kim ..... G09G 3/3614 345/691

* cited by examiner

*Primary Examiner* — Andrew Sasinowski
*Assistant Examiner* — Kuo Woo
(74) *Attorney, Agent, or Firm* — Dentons US LLP

(57) ABSTRACT

Disclosed is an LCD device. The LCD device includes a panel in which a plurality of gate lines cross a plurality of data lines, a source driving IC configured to alternately output a current data voltage and a current common voltage, a common electrode connected to the source driving IC through at least two or more common voltage lines, and a timing controller configured to generate current image data used to generate the current data voltage and common voltage data used to generate the current common voltage to be outputted to the source driving IC in correspondence with the current data voltage.

11 Claims, 6 Drawing Sheets

(@R = 1kΩ, C = 0.16uF, f = 10KHz)

(a)

(@R = 1kΩ, C = 0.16uF, f = 1KHz)

(b)

(@R = 1kΩ, C = 0.16uF, R = 10kΩ, C = 0.16uF, f = 1KHz)

LIQUID CRYSTAL DISPLAY DEVICE AND DRIVING METHOD THEREOF

CROSS-REFERENCE TO RELATED APPLICATIONS

This application claims the benefit of the Korean Patent Application No. 10-2012-0150467 filed on Dec. 21, 2012, which is hereby incorporated by reference for all purposes as if fully set forth herein.

BACKGROUND OF THE INVENTION

Field of the Invention

The present invention relates to a liquid crystal display (LCD) device. More particularly, the present invention relates to a method for reducing a ripple caused by the common voltage.

Discussion of the Related Art

Flat panel display (FPD) devices are applied to various electronic devices such as portable phones, tablet personal computers (PCs), notebook computers, etc. The FPD devices include liquid crystal display (LCD) devices, plasma display panels (PDPs), organic light emitting diode (OLED) display devices, etc. Recently, electrophoretic display (EPD) devices are widely used as the FPD devices.

In the FPD devices, especially, the LCD devices can be applied to all electronic devices ranging from small devices to large devices, and thus are being widely used.

Liquid crystal injected into an LCD device is driven according to a voltage difference between a data voltage supplied to a pixel electrode and a common voltage supplied to a common electrode to change a light transmittance, thereby enabling an image to be displayed.

FIG. 1 is an exemplary diagram illustrating a configuration of a related art LCD device.

The related art LCD device, as illustrated in FIG. 1, includes a panel 10 in which a plurality of pixels are respectively formed in a plurality of areas defined by a plurality of gate lines and a plurality of data lines and liquid crystal is charged into the pixels, at least one or more source driving ICs 30 that output data voltages to the respective data lines, at least one or more gate driving ICs 20 that sequentially output a scan signal to the gate lines, a timing controller 40 that controls the source driving ICs 30 and the gate driving ICs 20, and a power supply 50 that supplies a common voltage to a common electrode 12 formed in the panel 10.

The LCD device having the above-described configuration is generally driven by an inversion system in which a polarity of a data voltage applied to each liquid crystal cell is periodically inverted, for preventing the liquid crystal charged into the panel 10 from being deteriorated.

When the LCD device is driven by the inversion system, an image quality of the LCD device can be degraded depending on a correlation between a polarity of a data voltage charged into each pixel and a pattern of input image data.

The reason is because, due to data voltages charged into the respective pixels, polarities of the data voltages charged into the respective pixels may not have a balance between the positive polarity and the negative polarity in number, and one of the positive polarity and the negative polarity becomes the dominant polarity, causing a shift of the common voltage applied to the common electrode.

When the common voltage is shifted, a reference electric potential of each pixel is shaken, and for this reason, a user can feel a crosstalk, a flicker, a ripple, or a smear from an image displayed by the LCD device.

The related art LCD device uses the following methods for preventing a noise such as a ripple caused by the shift of the common voltage.

First, in terms of a structure of the related art LCD device, the common electrode is formed to minimize a resistance of the common electrode, and a circuit is configured to reduce a parasitic capacitance.

Second, in terms of a method of the related art LCD device, as illustrated in FIG. 1, a common voltage feedback compensation circuit 60 using an inverting operational amplifier is used.

However, due to a physical limitation, a solution to the device structure has a limitation in solving the above-described defects.

Moreover, in a solution to the driving method, because a Resistance/capacitance (R/C) differential occurs depending on a position of the common electrode 12, it is not easy to compensate for the common voltage all over the entire area of the panel 10, and when an input resistance of a common voltage line through which the common voltage is transferred is large, a compensation effect is weak. Especially, an R/C differential occurs between an upper end and lower end of the panel 10, and thus, when the compensation circuit 60 is optimized for compensating for a ripple caused by the common voltage, the common voltage applied to the upper end is overcompensated, causing a C/T defect to be intensified.

That is, as the demand for a narrow bezel increases, a width of the common voltage line decreases in designing the panel 10, and thus a resistance of the common voltage line increases, causing an increase in load of the common voltage line. For this reason, the related art compensation circuit 60 using a common voltage feedback (Vcom FB) is reduced in efficiency, causing problems such as C/T.

SUMMARY OF THE INVENTION

Accordingly, the present invention is directed to an LCD device and a driving method thereof that substantially obviate one or more problems due to limitations and disadvantages of the related art.

An advantage of the present invention is to provide an LCD device in which the number of common voltage lines applying a common voltage to a common electrode increases and the common electrode is formed as two or more common electrode blocks, and a driving method thereof.

Additional advantages and features of the invention will be set forth in part in the description which follows and in part will become apparent to those having ordinary skill in the art upon examination of the following or may be learned from practice of the invention. These and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an LCD device including: a panel in which a plurality of gate lines cross a plurality of data lines; a source driving IC configured to alternately output a current data voltage and a current common voltage; a common electrode connected to the source driving IC through at least two or more common voltage lines; and a timing controller configured to generate current image data used to generate the current data voltage and common voltage data used to generate the current common voltage to be outputted to the source driving IC in correspondence with the current data voltage.

In another aspect of the present invention, there is provided a method of driving an LCD device, including: generating a current image data by using a current input image data and a current common voltage data corresponding to the current image data; converting the current image data into a current data voltage and outputting the current data voltage to a corresponding data line; and generating a current common voltage from the current common voltage data to a common electrode before or after the outputting the current data voltage to the corresponding data line.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE ILLUSTRATED EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 1:
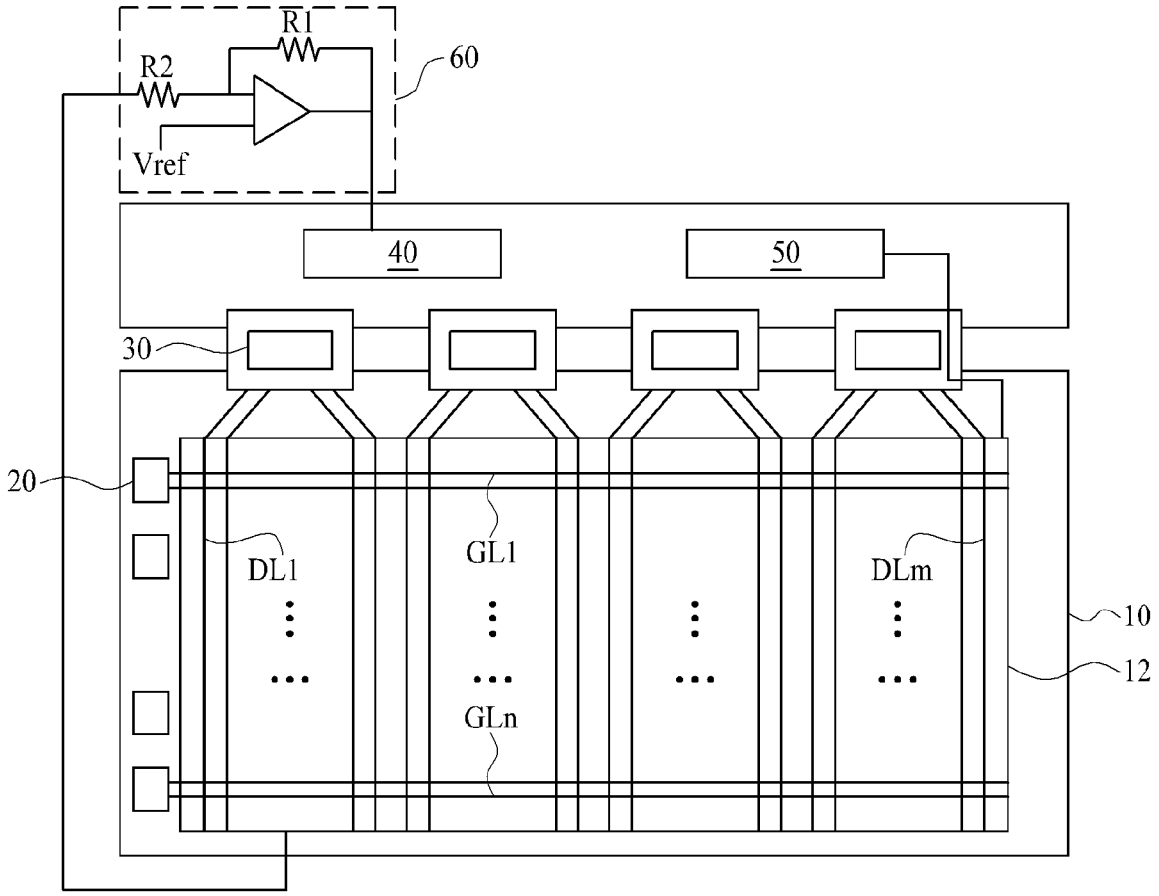
FIG. 1 Related Art
FIG. 1 is an exemplary diagram illustrating a configuration of a related art LCD device.
Figure 2:
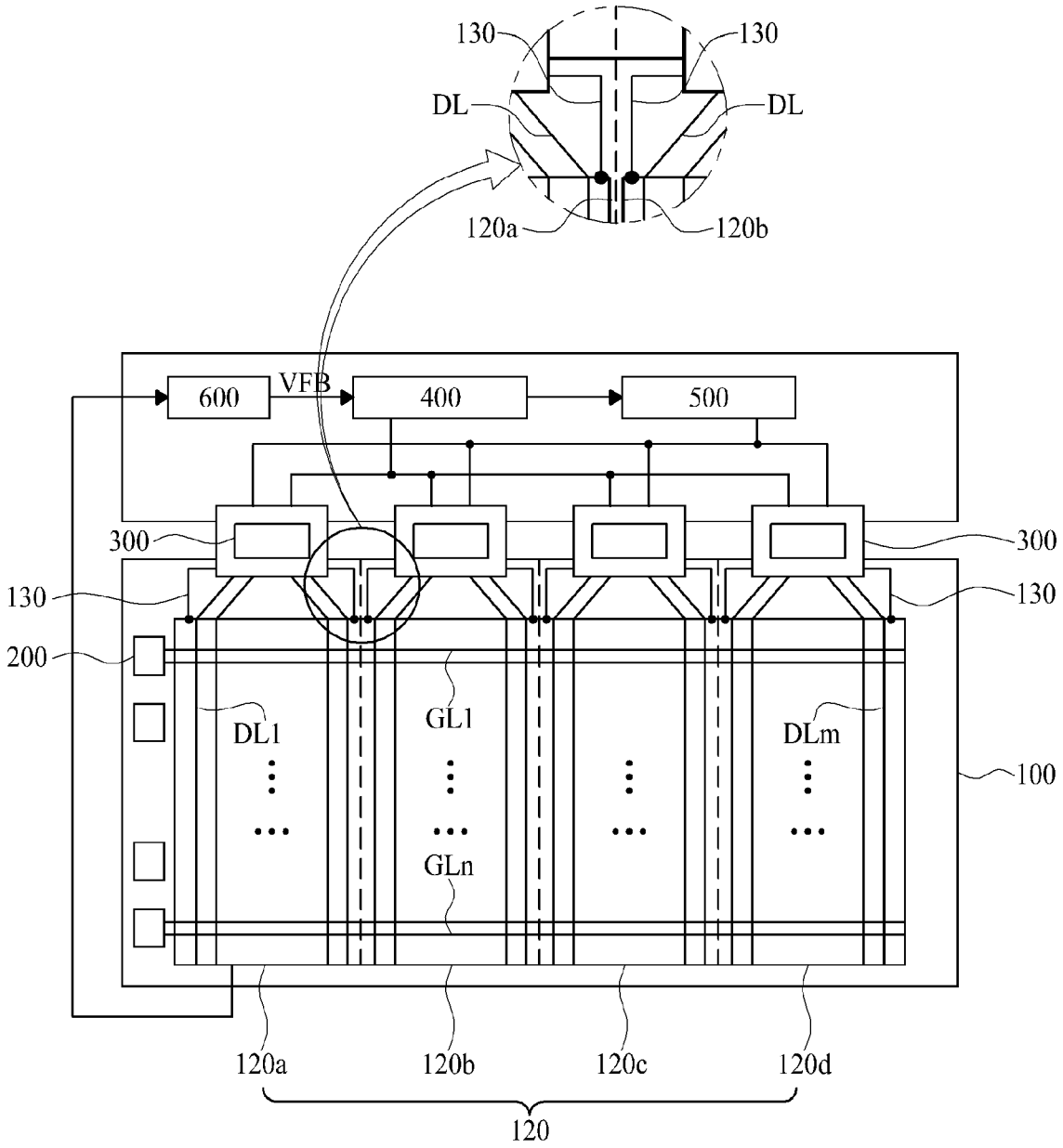
FIG. 2 is a configuration diagram illustrating an embodiment of an LCD device according to the present invention.
Figure 3:
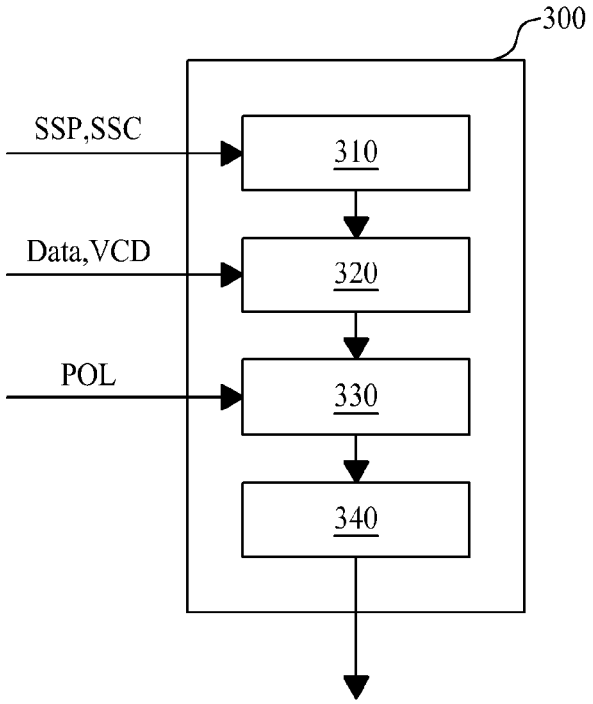
FIG. 3 is a configuration diagram illustrating an embodiment of a source driving IC of FIG. 2.
Figure 4:
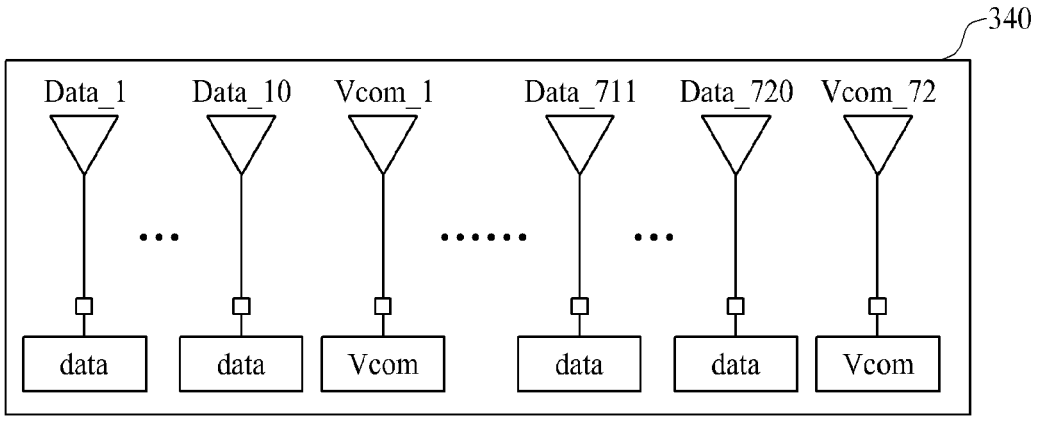
FIG. 4 is a configuration diagram illustrating an embodiment of an output buffer applied to the source driving IC of FIG. 3.
Figure 5:
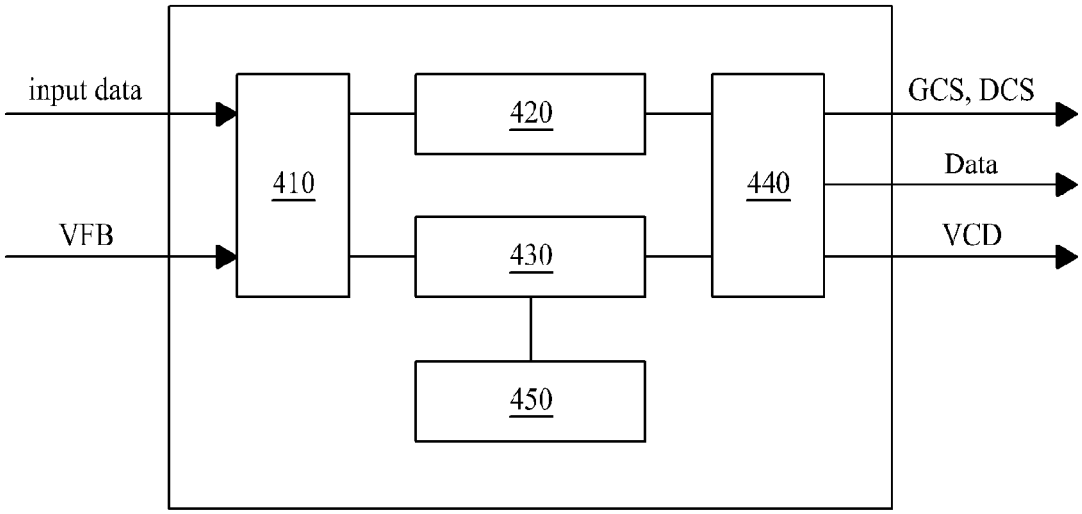
FIG. 5 is a configuration diagram illustrating an embodiment of a timing controller of FIG. 2.
Figure 6:
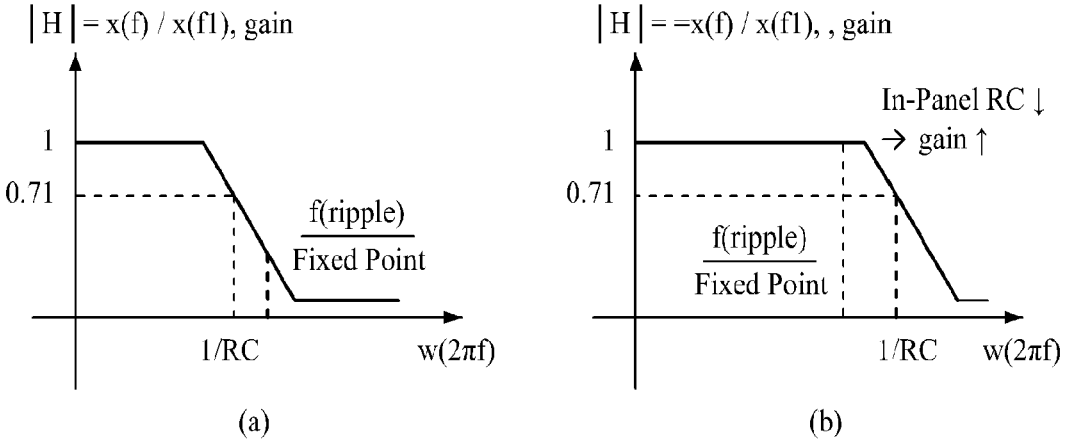
FIGS. 6 and 7 are exemplary diagrams for describing an enhancement of a transfer characteristic based on a change in resistance of a common voltage line in the LCD device according to the present invention.
Figure 7:
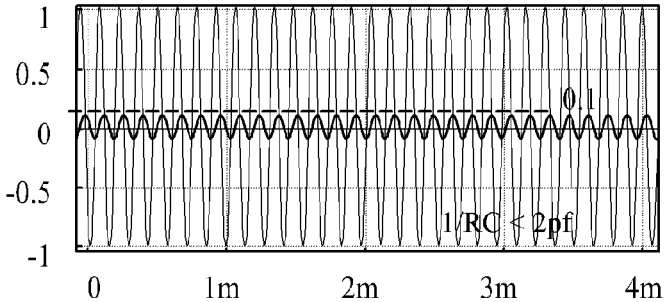
Figure 7:
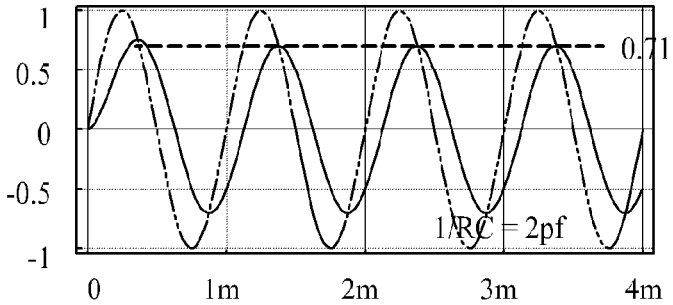
Figure 8:
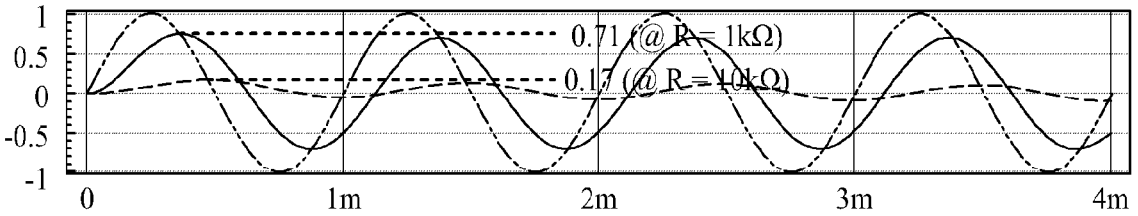
FIG. 8 is an exemplary diagram for describing an output waveform based on a change in R value in the LCD device according to the present invention.

FIG. 2 is a configuration diagram illustrating an embodiment of an LCD device according to the present invention, FIG. 3 is a configuration diagram illustrating an embodiment of a source driving IC of FIG. 2, FIG. 4 is a configuration diagram illustrating an embodiment of an output buffer applied to the source driving IC of FIG. 3, FIG. 5 is a configuration diagram illustrating an embodiment of a timing controller of FIG. 2, FIGS. 6 and 7 are exemplary diagrams for describing an enhancement of a transfer characteristic based on a change in resistance of a common voltage line in the LCD device according to the present invention, and FIG. 8 is an exemplary diagram for describing an output waveform based on a change in R value in the LCD device according to the present invention.

The present invention is to solve defects such as a crosstalk and a smear which are caused by a common voltage noise due to a data coupling.

Generally, LCD devices drive liquid crystal with a positive data voltage and a negative data voltage to prevent the liquid crystal from being deteriorated.

When the LCD devices are driven as described above, the common voltage is shifted due to an unbalance (asymmetry) between the positive data voltage and the negative data voltage in number, and for this reason, a ripple noise increases, causing an image-quality defect such as a crosstalk and a smear.

The present invention is to remove a defect caused by the above-described principle, predict a defect caused by a shift of the common voltage through data analysis, and output a common voltage, which is capable of solving the defect, to a common electrode through a source driving IC.

Specifically, the present invention outputs the common voltage to a plurality of the common electrodes through a plurality of the source driving ICs, thus reducing a resistance difference between positions of the common electrodes. Also, the present invention separately transfers the common voltage, which is capable of removing a defect in a corresponding common electrode block, to a plurality of common electrode blocks and thus can reduce a C/T level differential caused by various patterns.

To this end, as illustrated in FIG. 2, an LCD device according to the present invention includes: a panel 100 in which a plurality of gate lines GL1 to GL intersect a plurality of data lines DL1 to DLm; a source driving IC 300 that alternately outputs a current data voltage and a current common voltage to each of the data lines; a common electrode 120 that is connected to the source driving IC 300 through at least two or more common voltage lines 130, and is formed at the panel 100 in connection with the common voltage lines 130; a power supply 500 that generates a driving voltage to generate the current data voltage and the current common voltage, and transfers the driving voltage to the source driving IC 300; a timing controller 400 that generates current image data used to generate the current data voltage and common voltage data used to generate the current common voltage to be outputted from the source driving IC 300 in correspondence with the current data voltage, and transfers the current image data and the common voltage data to the source driving IC 300; an analog-to-digital converter (ADC) 600 that converts a feedback common voltage (an analog signal) fed back from the common electrode 120 into a digital signal, and supplies the digital signal to the timing controller 400; and a gate driving IC 200 that sequentially supplies a scan signal to the gate lines.

The panel 100 includes a plurality of pixels that are respectively formed in a plurality of areas defined by the plurality of gate lines GL1 to GLn and the plurality of data lines DL1 to DLm. Each of the pixels includes a thin film transistor (TFT) and a pixel electrode.

The TFT supplies a data voltage (an image signal) applied through a corresponding data line to the pixel electrode in response to the scan signal applied through a corresponding gate line. The pixel electrode drives liquid crystal between the pixel electrode and the common electrode 120 in response to the data voltage, thereby adjusting a light transmittance.

The panel 100 of the present invention may be applied to all liquid crystal modes including a twisted nematic (TN) mode, a vertical alignment (VA) mode, an in-plane switching (IPS) mode, and a fringe field switching (FFS) mode. Also, the LCD device according to the present invention may be implemented as a transmissive LCD device, a semi-transmissive LCD device, a reflective LCD device, or the like.

The gate driver 200 sequentially supplies the scan signal to the gate lines by using gate control signals GCS generated by the timing controller 400. That is, the gate driving IC 200 applied to the present invention may use a gate driving IC applied to LCD devices of the related art.

The gate driving IC 200 applied to the present invention, as illustrated in FIG. 4, may be provided in a gate-in panel (GIP) type which is built into the panel 100. Alternatively, the gate driving IC 200 may be provided independently from the panel 100, and electrically connected to the panel 100 in various types.

The number of gate driving ICs 200 may be varied depending on a size of the panel 100.

The source driving IC 300 converts digital image data transferred from the timing controller 400 into data voltages, and supplies the data voltages for one horizontal line to the data lines at every one horizontal period in which the scan signal is supplied to a corresponding gate line.

That is, the source driving IC 300 converts the image data into the data voltages by using gamma voltages supplied from a gamma voltage generator (not shown), and outputs the data voltages to the respective data lines.

To this end, as illustrated in FIGS. 3 and 4, the source driving IC 300 includes a shift register 310, a latch 320, a digital-to-analog converter (DAC) 330, and an output buffer 340.

The source driving IC 300, as illustrated in FIG. 4, may receive image data from the timing controller 400 by using an embedded point to point interface (EPI) type interface, or may receive the image data from the timing controller 400 by using a mini-low voltage differential signaling (mini-LVDS) type interface.

The shift register 310 generates a sampling signal by using data control signals SSC and SSP received from the timing controller 400.

The latch 320 latches the digital image data Data sequentially received from the timing controller 400, and then simultaneously outputs the latched image data to the DAC 330.

Especially, in addition to the image data Data, common voltage data VCD is inputted to the latch 320.

That is, the timing controller 400 generates the image data Data for outputting an image and the common voltage data VCD for outputting the common voltage, and transfers the image data Data and the common voltage data VCD to the latch 320 simultaneously or sequentially.

For example, when each of the image data is composed of 8 bits, the common voltage data VCE may also be transferred by using 8 bits. However, only some of the 8 bits may be used depending on the number of common voltage data.

For example, when the number of common voltages to be converted is sixteen, the common voltage data may be transferred by using only 4 bits among 8 bits used to transfer the image data.

The DAC 330 simultaneously converts the image data, transferred from the latch 320, into positive or negative data voltages, and outputs the positive or negative data voltages. Specifically, the DAC 330 converts the image data into the positive or negative data voltages (data signals) by using a polarity control signal POL transferred from the timing controller 400, and outputs the positive or negative data voltages to the respective data lines DL.

Especially, the DAC 330 may change a polarity of the image data according to a polarity control signal POL transferred from the timing controller 400.

Moreover, the DAC 330 may generate one common voltage by using the common voltage data transferred from the latch 320. That is, the DAC 330 generates a common voltage to be outputted to the common electrode 120 by using the common voltage data.

The output buffer 340 outputs the positive or negative data voltages, transferred from the DAC 330, to the respective data lines DL of the panel 100 according to a source output enable signal SOE transferred from the timing controller 400. At this time, the output buffer 340 amplifies the data voltages transferred from the DAC 330, and outputs the amplified data voltages to the data lines formed in the panel 100.

In addition, the output buffer 340 outputs the common voltage, transferred from the DAC 330, to the common electrode 120 of the panel 100 according to a common voltage output control signal transferred from the timing controller 400. Here, the common voltage output control signal is for adjusting a timing for outputting the common voltage to the common electrode 120, and the timing controller 400 may shift the source output enable signal SOE to generate the common voltage output control signal, or the common voltage output control signal may be generated separately from the source output enable signal SOE.

The common voltage may be outputted to the common electrode 120 before or after the data voltage is outputted to the data line DL. That is, the data voltage is outputted according to a horizontal sync signal Vsync in one horizontal period, and thus may be outputted before or after the one horizontal period. In this case, the data voltage may correspond to a data voltage which is outputted before the one horizontal period, or may correspond to a data voltage which is outputted after the one horizontal period.

The above-described correspondence relationship may be set according to intervals at which the common voltage is outputted.

For example, when a current data voltage is outputted immediately after a current common voltage is outputted, liquid crystal of each pixel may be driven with the current data voltage and the current common voltage, thereby displaying an image.

The output buffer 340, as illustrated in FIG. 4, may be configured for outputting the data voltage and the common voltage. Specifically, as illustrated in FIGS. 2 and 4, the output buffer 340 may include at least one or more common voltage terminals connected to the common voltage line 130 formed in the panel 100 and a plurality of data voltage terminals connected to the respective data lines DL formed at the panel 100.

The number of source driving ICs 300 may be variously set depending on a size of the panel 100.

The common electrode 120 is connected to the source driving IC 300 through at least two or more common voltage lines 130, and is formed at the panel 100 in connection with the common voltage lines 130.

The common electrode 120 may be formed all over the panel 100 in a plate shape or a slit shape.

The common electrode 120 may be formed as one plate connected to the common voltage lines 130, or as illustrated in FIG. 2, may be formed as at least two or more common electrode blocks connected to the common voltage lines 130. In FIG. 2, four common electrode blocks 120*a* to 120*d* are illustrated.

In this case, the common electrode blocks 120*a* to 120*d* may respectively receive the common voltage from different source diving ICs 300. Specifically, as illustrated in an enlarged elliptical block of FIG. 2, the four common electrode blocks 120*a* to 12*d* are separated from each other, and each of the common electrode blocks 120*a* to 12*d* is connected to the source driving IC 300 corresponding thereto through a corresponding common voltage line 130 to receive the common voltage.

The power supply 500 generates a driving voltage to generate data voltages and the common voltage, and transfers the driving voltage to the source diving ICs 300.

The ADC 600 converts an analog feedback common voltage (an analog signal) VFB fed back from the common electrode 120 into a digital signal, and supplies the digital signal to the timing controller 400.

The ADC 600, as illustrated in FIG. 2, may be provided independently from the timing controller 400 to be mounted on a main board, or provided in the timing controller 400. In this case, the ADC 600 may be provided in a specific element, especially, a receiver 400, of the timing controller 400 of FIG. 5.

The timing controller 400 generates current image data used to generate a current data voltage and common voltage data used to generate a current common voltage to be outputted from the source driving IC 300 in correspondence with the current data voltage, and transfers the current image data and the common voltage data to the source driving IC 300.

Here, the current image data is data that is outputted by realigning current input image data inputted from an external system to the timing controller 400 according to a pixel structure of the panel 100. The current data voltage is a voltage that the source driving IC 300 outputs to the data line by using the current input image data. The common voltage data is data corresponding to the current image data. The current common voltage is a common voltage which the source driving IC 300 generates by using the common voltage data which is outputted to the source driving IC 300 by the timing controller 400, in order to drive the liquid crystal together with the current data voltage, and is outputted to the common electrode 120. That is, the current image data, the current input image data, the current data voltage, the current common voltage data, and the current common voltage are information having an interaction relationship for displaying an image.

Previous image data, previous input image data, previous data voltage, previous common voltage data, and previous common voltage to be described below are information that also have the same relationship as the relationship between the current image data, the current input image data, the current data voltage, the current common voltage data, and the current common voltage, and is temporally prior to the current image data, the current input image data, the current data voltage, the current common voltage data, and the current common voltage.

In the following description, when it not required to specially classify the information, the present invention will be described by using the terms "image data, input image data, data voltage, common voltage data, and common voltage."

The timing controller 400 generates a gate control signal GCS for controlling an operation timing of the gate driving ICs 200 and a data control signal DCS for controlling an operation timing of the source driving ICs 300 by using a plurality of timing signals, namely, a vertical sync signal Vsync, a horizontal sync signal Hsync, a data enable signal DE, etc., inputted from an external system. Also, the timing controller 400 generates image data to be transferred to the source driving ICs 300.

That is, the timing controller 400 realigns the input video data inputted from the external system according to a structure and characteristic of the panel 100, and transfers the realigned image data to the source driving IC 300.

To this end, as illustrated in FIG. 5, the timing controller 400 may include a data aligner 430.

The timing controller 400 generates the data control signal DCS for controlling the source driving IC 300 and the gate control signal GCS for controlling the gate driving IC 200 by using the timing signals (i.e., the vertical sync signal Vsync, the horizontal sync signal Hsync, the data enable signal DE, etc.) transferred from the external system, and respectively transfers the control signals to the source driving IC 300 and the gate driving IC 200.

To this end, as illustrated in FIG. 5, the timing controller 400 may include a control signal generator 420.

The gate control signal (GCS) generated by the control signal generator 420 includes a gate start pulse (GSP), a gate shift clock (GSC), a gate output enable signal (GOE), a gate start signal (VST), and a gate clock (GCLK).

The data control signal DCS generated by the control signal generator 420 includes a source start pulse SSP, a source shift clock SSC, the source output enable signal SOE, and the polarity control signal POL.

Moreover, the above-described common voltage output control signal may also be outputted by the control signal generator 410.

Moreover, the timing controller 400 may include a storage unit 450 that stores parameters to be applied to generate the common voltage data and an output unit 440 that outputs the image data and the common voltage data to the source driving IC 300.

A below-described function of the timing controller 400 may be performed by the data aligner 430 or the receiver 410 among the above-described elements. When the receiver 410 performs the following function, the storage unit 450 may be connected to the receiver 410. For convenience, the present invention will be described with a case, in which the timing controller 400 performs the following functions, as an example.

First, the timing controller 400 generates current image data used to generate a current data voltage and common voltage data used to generate a current common voltage to be outputted from the source driving IC 300 in correspondence with the current data voltage, and transfers the current image data and the common voltage data to the source driving IC 300.

That is, the timing controller 400 generates image data used to generate the current data voltage to be outputted to the panel 100 and current common voltage data used to generate a current common voltage to be outputted to the common electrode 120, and transfers the image data and the current common voltage data to the source driving IC 300.

Moreover, the timing controller 400 corrects and stores a parameter used to generate the current common voltage data by using previous common voltage data and the feedback common voltage VFB that is outputted to the common electrode 120 by the previous common voltage data and fed back therefrom.

Specifically, the previous common voltage is outputted to the common electrode 120 by the previous common voltage data, and the previous common voltage supplied to the common electrode 120 is transferred as the feedback common voltage VFB to the timing controller 400. The feedback common voltage VFB may be a voltage that is changed to a digital value by the ADC 600, or when the ADC 600 is provided in the receiver 410, the feedback common voltage VFB may be an analog value. Hereinafter, for convenience, the present invention will be described with a case, in which the feedback common voltage VFB is changed to the digital value by the ADC 600 provided outside the timing controller 400, as an example. That is, the common voltage (an analog voltage) outputted to the common electrode 120 is inputted to the ADC 600, changed to a digital value, and inputted to the timing controller 400.

The parameter may be used to generate the current common voltage data. That is, in the ideal case, a level of the previous common voltage outputted by the previous common voltage data should be the same as the feedback common voltage VFB.

However, the common electrode 120 may have different resistances in respective areas by an interaction with the elements of the panel 100. Therefore, the previous common voltage data and the feedback common voltage may have different values.

The timing controller 400 corrects and stores the parameters in order for the previous common voltage data and the feedback common voltage to have, for example, the same value.

When the current common voltage data is generated by using the corrected parameters, a level difference between the current common voltage outputted by the current common voltage data and a feedback common voltage based on the current common voltage may be set less than a level difference between the previous common voltage and a feedback common voltage based on the previous common voltage.

That is, in order to obtain the above-described effect, the parameters may be applied to a case that generates various control signals transferred to the gate driving IC 200 and the source driving IC 300, and generates the current image data by using the current input image data.

Moreover, the timing controller 400 may analyze a change amount of the current data voltages to be simultaneously outputted in units of a horizontal line of the panel 100, and then generate the current common voltage data corresponding to the change amount of the current data voltages to transfer the current common voltage data to the source driving IC 300.

In detail, since the common voltage is generally shifted according to a change amount of data voltages simultaneously outputted in units of a horizontal line to generate a ripple, the present invention analyze a change amount of current data voltages simultaneously outputted in units of a horizontal line by using the current image data or the current input image data, and then generates current common voltage data for minimizing ripples caused by the change amount. Therefore, when the current common voltage based on the current data voltages is outputted, a shift of the current common voltage by the changes in the data voltages can be minimally performed, thus minimizing noises such as ripples.

That is, the timing controller 400 may calculate a change amount of data voltage of the input image data and a degree, by which the common voltage is shifted according to the change amount of data voltage, to generate the common voltage data for compensating for the shift of the common voltage.

The common electrode 120, as described above, may be formed as at least two or more common electrode blocks 120*a* to 120*d*, which may respectively receive the common voltage from different source driving ICs 300. In this case, the timing controller 400 may analyze a change amount of the current data voltages to be simultaneously outputted in units of a horizontal line of the panel 100, and then generate the current common voltage data corresponding to the change amount of the current data voltages to transfer the current common voltage data to a corresponding source driving IC 300, for each common electrode block 120*a* to 120*d*.

That is, by using the above-described methods, the timing controller 400 may generate the current common voltage data for each common electrode block, and then transfer the current common voltage data to the source driving IC 300 corresponding to each common electrode block.

The above-described features of the present invention will be summarized as follows.

First, the present invention can reduce a resistance of an input/output part caused by a multi-channel common voltage.

That is, as illustrated in FIG. 2, the common voltage line 130 for supplying the common voltage to the common electrode 120 is provided in plurality, thus reducing the resistance of an input/output part of the common electrode 120.

As the number of common voltage lines 130 for applying the common voltage increases, common voltage resistances are in parallel to be reduced, and thus, a cutoff frequency increases. Accordingly, a transfer characteristic of the common electrode 120 can be enhanced, and a compensation effect can be optimized, thus reducing common voltage ripples.

For example, in the related art LCD device using one common voltage line, when an application resistance of the one common voltage line is 900Ω, a formula "$1/R_{Total}$=number of lines/1 line resistance=2/900Ω=1/450Ω" is established, and thus, $R_{Total}$ is 450Ω (i.e., $R_{Total}$=450Ω).

On the other hand, in the LCD device according to the present invention, when an application resistance of the one common voltage line is 900Ω, a formula "$1/R_{Total}$=number of lines/1 line resistance=72/450Ω=0.08" is established, and thus, $R_{Total}$ is 12.5Ω (i.e., $R_{Total}$=12.5Ω).

That is, according to the present invention, a resistance of the common electrode 120 can be reduced.

Moreover, according to the above-described features of the present invention, a common voltage resistance deviation between an input part and an output part can also be reduced.

Second, the present invention can compensate for a common voltage ripple for each common electrode block 120*a* to 120*d*.

A method of compensating for the common voltage ripple is as follows.

The method compares a change amount of voltages between data lines, such as Nth line data and N−1th line data. In this case, digital data is changed to a voltage value.

A direction and amount of common voltage ripple can be predicted by adding the compared values.

The method multiplies an algorithm internal parameter to the predicted value (line differential/channel differential correction).

A common voltage for counteracting a ripple, which is generated at a time when Nth line data is charged, is outputted to the source driving IC 300 according to the predicted value.

The method samples a ripple, which is compensated for through a feedback line (FB Line), to correct a parameter of each line, and stores the corrected parameter. In a next frame, the method reflects the stored parameter to compensate for a ripple.

Next, the present invention can improve a horizontal C/T of the panel 100.

That is, a common voltage ripple deviation between different positions in the panel 100 occurs, and when a left C/T level differs from a right C/T level, the present invention can optimize the common voltage for each source driving IC.

FIGS. 6 and 7 are exemplary diagrams for describing an enhancement of a transfer characteristic based on a change in resistance of a common voltage line in the LCD device according to the present invention. Particularly, FIG. 6 shows a relationship between a ripple occurrence frequency and a resistance. FIG. 6(*a*) shows a relationship between a ripple occurrence frequency and a resistance in the related art LCD device, and FIG. 6(*b*) shows a relationship between a ripple occurrence frequency and a resistance in the LCD device according to the present invention.

Here, FIG. 6(*a*) shows a case in which a common voltage ripple frequency is greater than 1/RC in the panel 100, and FIG. 6(*b*) shows a case in which the common voltage ripple frequency is less than 1/RC in the panel 100.

Moreover, FIG. 7(*a*) is a graph applied to the related art LCD device, FIG. 7(*b*) is a graph applied to the LCD device according to the present invention.

Referring to FIGS. 6 and 7, it can be seen that as a resistance of the outermost common voltage line decreases, the cutoff frequency increases, and thus, an enhancement of a transfer characteristic and a compensation effect can be optimized.

FIG. 8 is an exemplary diagram for describing an output waveform based on a change in R value in the LCD device according to the present invention. It can be seen that as the R value increases, a frequency filter area increases, and thus, an output is stabilized.

Hereinafter, a method of driving the LCD device according to the present invention will be described in detail with reference to FIG. 9. In the following description, a description repetitive of the above-described details is not provided, or will be simply made.

Figure 9:
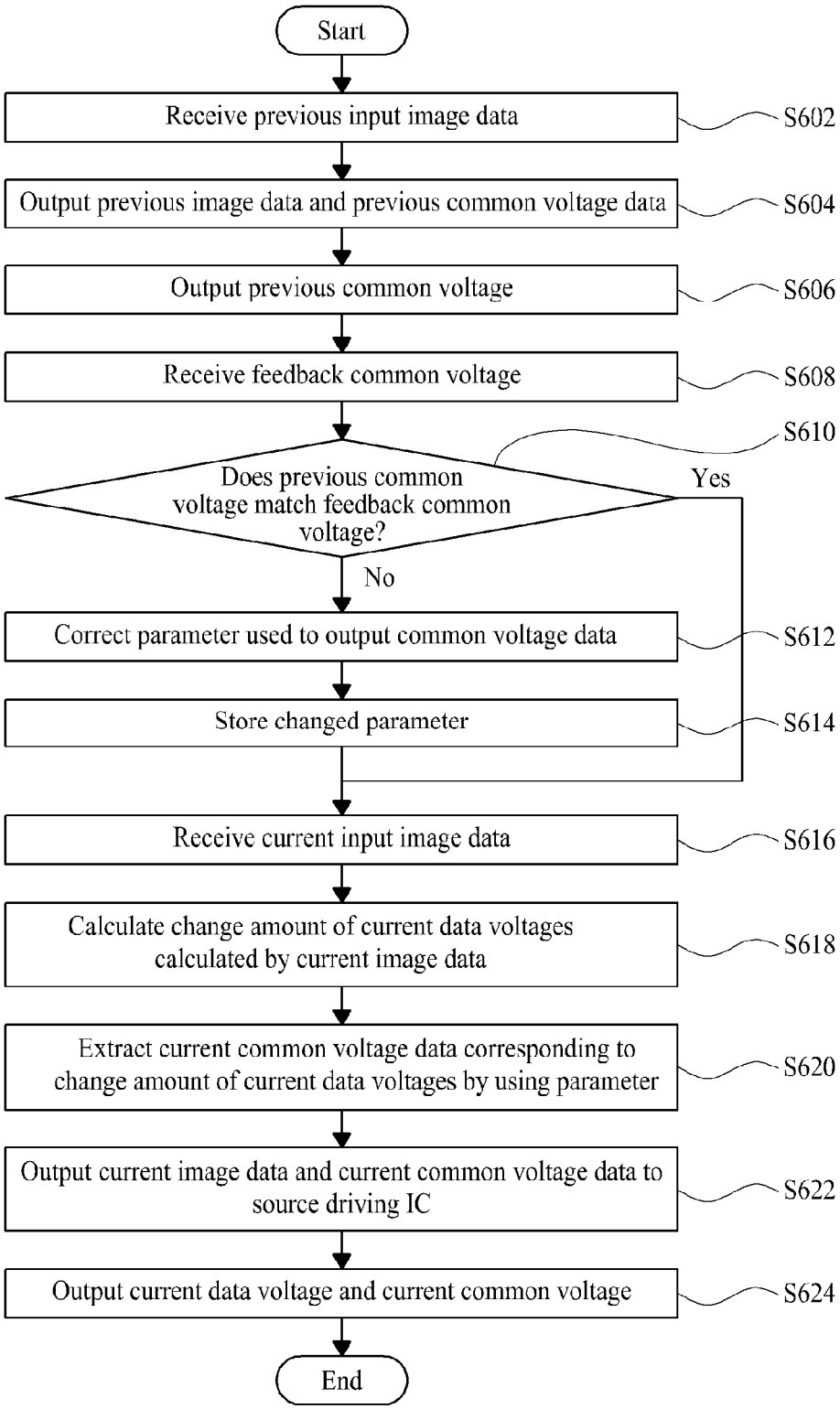
FIG. 9 is a flowchart illustrating an embodiment of a method of driving the LCD device according to the present invention.

FIG. 9 is a flowchart illustrating an embodiment of a method of driving the LCD device according to the present invention.

The method of driving the LCD device according to the present invention includes: operation S616 in which the timing controller 400 receives current input image data; operation S622 in which the timing controller 400 generates current image data by using the current input image data, and transfers the current image data to the source driving IC 300; operation S620 in which the timing controller 400 generates current common voltage data to be outputted in correspondence with the current image data, and transfers the current common voltage data to the source driving IC 300; and operation S624 in which the source driving IC 300 converts the current image data into a current data voltage, and outputs the current common voltage to the common electrode 120 before or after outputting the current data voltage to a corresponding data line.

The method of driving the LCD device according to the present invention may further includes operations S610 to S614 in which the timing controller 400 corrects a parameter used to generate the current common voltage data by using a feedback common voltage which is outputted to the common electrode 120 by previous common voltage data and fed back therefrom.

In operation S622 of generating the current common voltage data, the timing controller 400 may generate the current common voltage data by using the parameter in operation S620.

Moreover, operation S622 of generating the current common voltage data may include: operation S618 in which the timing controller 400 analyzes a change amount of the current data voltages to be simultaneously outputted in units of a horizontal line of the panel 100; operation S620 in which the timing controller 400 generates the current common voltage data corresponding to the change amount of the current data voltages; and operation S622 in which the timing controller 400 transfers the current common voltage data to the source driving IC 300.

Moreover, operation S622 of generating the current common voltage data may include: operation S618 in which the timing controller 400 analyzes a change amount of the current data voltages to be simultaneously outputted in units of a horizontal line of the panel 100; operation S620 in which the timing controller 400 generates the current common voltage data corresponding to the change amount of the current data voltages for each of the common electrode blocks respectively connected to the source driving ICs 300; and operation S622 in which the timing controller 400 transfers the current common voltage data to a corresponding source driving IC 300.

In the method according to the present invention, the timing controller 400 receives previous input image data in operation S602, and outputs previous image data and previous common voltage data. The source driving IC 300 outputs the previous common voltage in operation S606.

When the previous common voltage is received as a feedback common voltage in operation S608, the timing controller 400 determines whether the previous common voltage matches the feedback common voltage in operation S610.

When it is determined that there is a mismatch therebetween, the timing controller 400 correct a parameter used to output common voltage data in operation S612, and stores the corrected parameter in operation S614. When it is determined that there is a match therebetween, the timing controller 400 prepares to receive the current input image data.

When current input image data are received in operation S616, the timing controller 400 calculates a change amount of the current data voltages which are calculated with the current image data in operation S618.

The timing controller 400 extracts current common voltage data corresponding to the change amount of the current data voltages by using the parameter in operation S620.

The timing controller 400 outputs the current image data and the current common voltage data to the source driving IC 300 in operation S622.

The source driving IC 300 generates a current data voltage and a current common voltage, and outputs the current data voltage and the current common voltage to the data line DL and the common electrode 120, respectively.

According to the present invention, a common voltage ripple deviation between different positions in the panel can be reduced, and a Front of Screen (FOS) image defect can be solved, thus reducing horizontal Cross Talk (C/T).

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display (LCD) device comprising:

a panel in which a plurality of gate lines cross a plurality of data lines;

a source driving IC configured to alternately output a current data voltage and a current common voltage;

a common electrode connected to the source driving IC through at least two or more common voltage lines; and a timing controller configured to generate a current image data used to generate the current data voltage and a current common voltage data used to generate the current common voltage to be outputted to the source driving IC, wherein the timing controller transfers the current image data and the current common voltage data to the source driving IC, and wherein the current common voltage data is changed according to a change amount of current data voltages to be simultaneously outputted to the plurality of data lines.

2. The LCD of claim 1, wherein the timing controller corrects and stores a parameter used to generate the current common voltage data by using previous common voltage data and a feedback common voltage that is outputted to the common electrode by the previous common voltage data and fed back therefrom.

3. The LCD of claim 1, wherein the timing controller analyzes a change amount of current data voltages to be simultaneously outputted in units of a horizontal line of the panel, generates the current common voltage data corresponding to the change amount of the current data voltages, and transfers the current common voltage data to the source driving IC.

4. The LCD of claim 3, wherein the timing controller generates the current common voltage data by using a previous data voltage and a feedback common voltage that is outputted to the common electrode according to the previous common voltage data and fed back therefrom.

5. The LCD of claim 1, wherein the timing controller calculates a change amount of data voltage of the input image data and a degree, by which the common voltage is shifted according to the change amount of data voltage, to generate the common voltage data for compensating for the shift of the common voltage.

6. The LCD of claim 1, wherein, the common electrode is formed as at least two or more common electrode blocks, and the common electrode blocks respectively receive the common voltage from different source diving ICs.

7. The LCD of claim 6, wherein the timing controller analyzes a change amount of the current data voltages to be simultaneously outputted in units of a horizontal line of the panel, generates the current common voltage data corresponding to the change amount of the current data voltages for each common electrode block, and transfers the current common voltage data to a corresponding source driving IC.

8. A method of driving an liquid crystal display (LCD) device, the method comprising:

generating a current image data by using a current input image data and a current common voltage data;

converting the current image data into a current data voltage and outputting the current data voltage to a corresponding data line; and generating a current common voltage from the current common voltage data to a common electrode before or after the outputting the current data voltage to the corresponding data line, wherein the current image data and the common voltage data are generated by a timing controller, and transferred to a source driving IC, wherein the source driving IC outputs the current data voltage and the current common voltage, and wherein the current common voltage data is changed according to a change amount of current data voltages to be simultaneously outputted to the plurality of data lines.

9. The method of claim 8, further comprising correcting a parameter used to generate the current common voltage data by using a feedback common voltage which is outputted to the common electrode by a previous common voltage data and fed back therefrom, wherein the generating the current common voltage data comprises generating the current common voltage data by using the parameter.

10. The method of claim 8, wherein the generating the current common voltage data comprises: analyzing a change amount of the current data voltages to be simultaneously outputted in units of a horizontal line of the panel; and generating the current common voltage data corresponding to the change amount of the current data voltages, and transferring the current common voltage data to a source driving IC.

11. The method of claim 8, wherein the generating the current common voltage data comprises:

analyzing a change amount of the current data voltages to be simultaneously outputted in units of a horizontal line of the panel;

generating the current common voltage data corresponding to the change amount of the current data voltages for each of the common electrode blocks respectively connected to a plurality of source driving ICs; and transferring, by the timing controller, the current common voltage data to a corresponding source driving IC.

* * * * *